United States Patent [19]

Allen

[11] 4,080,820

[45] Mar. 28, 1978

[54] IN-LINE CRIMPING TOOL

[75] Inventor: Irving Allen, Westbrook, Conn.

[73] Assignee: Walter Kidde & Company, Inc., Clifton, N.J.

[21] Appl. No.: 719,962

[22] Filed: Sep. 2, 1976

[51] Int. Cl.[2] ..... B21D 37/12

[52] U.S. Cl. ..... 72/410; 29/758

[58] Field of Search ..... 72/409, 410; 81/309, 81/313, 304, 311, 347, 353, 355, 362, 363, 367, 376; 29/203 H, 203 HC, 203 HM, 203 HT

[56] References Cited

U.S. PATENT DOCUMENTS

| | | | |
|---|---|---|---|
| 2,722,146 | 11/1955 | Byrem | 29/203 H |
| 2,914,976 | 12/1959 | Demler | 72/404 |
| 3,396,571 | 8/1968 | Porter | 72/410 |
| 3,412,596 | 11/1968 | Burns | 72/410 |
| 3,571,888 | 3/1971 | Di Filippo | 29/203 H |
| 3,688,553 | 9/1972 | Demler | 81/309 |
| 3,706,219 | 12/1972 | Hoffman et al. | 81/309 |
| 3,903,725 | 9/1975 | Rommel | 29/203 H |

FOREIGN PATENT DOCUMENTS

| | | | |
|---|---|---|---|
| 877,228 | 9/1961 | United Kingdom | 72/410 |

*Primary Examiner*—Michael J. Keenan
*Attorney, Agent, or Firm*—DeLio and Montgomery

[57] ABSTRACT

An in-line crimping tool having a U-shaped die holder carried by links connected symmetrically to pivotally connected arms, a ram being mounted on the arm pivot and the geometry of the parts being such that the closing together of the handle ends of the arms causes the ram to advance in a straight line, guided by the sides of the die holder, to crimp or compress an object interposed between the die and the ram.

1 Claim, 6 Drawing Figures

IN-LINE CRIMPING TOOL

This invention relates to a crimping tool wherein a die is mounted in a U-shaped die holder carried by twin toggle links connected symmetrically to forward points on pivotally connected arms, said points being laterally offset from the pivotal connection of the arms, a ram being mounted on the arm pivot and extending between the sides of the die holder which guide the ram in relative rectilinear movement toward and away from the die when the arms are moved.

Known crimping tools are of several types, the simplest being a plier-type tool wherein the working jaws may have normal plier motion about a pivot point, compound lever motion or parallel action, with varying degrees of mechanical advantage depending on the lever arm of each respective tool. An example of a plier-type parallel action tool is shown in Filia, U.S. Pat. No. 3,157,075, and a compound lever tool, without parallel action, is shown in Filia U.S. Pat. No. 3,673,848. Parallel in-line action, with the crimping movement longitudinally of the tool, is exemplified by Demler U.S. Pat. No. 2,892,368 wherein the crimping dies are all related primarily to a main or master handle of the tool which contains a guide channel along which a die support is moved by actuation of a second handle.

It is an object of the present invention to provide a crimping tool with plier-type arms pivotally connected adjacent their forward ends, a U-shaped die holder being connected to the ends of the arms by links and a ram being mounted on the arm pivot and adapted to be guided by the sides of the die holder.

It is a further object of the invention to provide a crimping tool wherein the relative movement of the die and ram is effected by symmetrical toggle action of the die holder, links and arm ends in response to movement of the arms.

It is another object of the invention to provide an in-line crimping tool of the type described with a motion-compelling mechanism.

It is still a further object of the invention to provide certain improvements in the form, construction and arrangement of the several parts whereby the above named and other objects may effectively be attained.

The invention accordingly comprises the features of construction, combination of elements, and arrangement of parts which will be exemplified in the construction hereinafter set forth, and the scope of the invention will be indicated in the claims.

A practical embodiment of the invention is shown in the accompanying drawing wherein.

Figure 1:
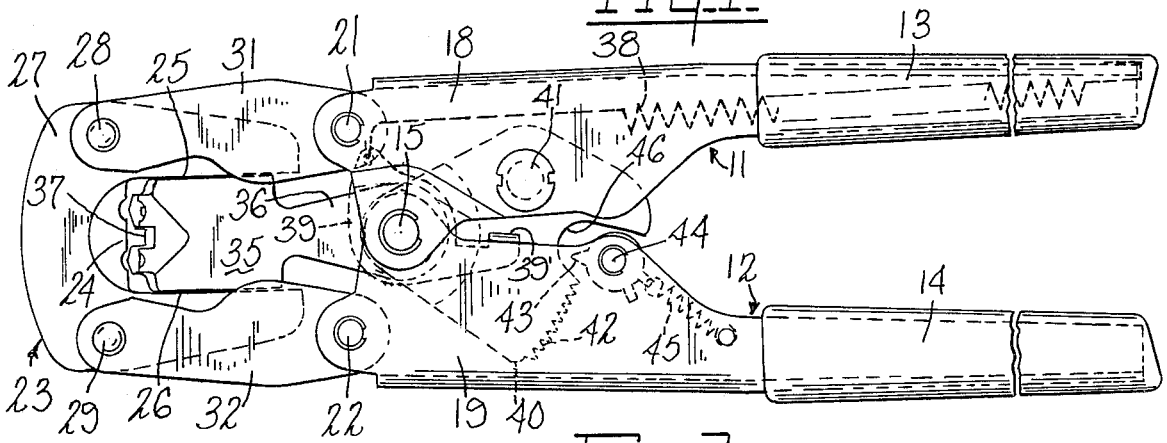
FIG. 1 represents a side elevation of the tool, in closed position, parts of the handle being broken away.
Figure 2:
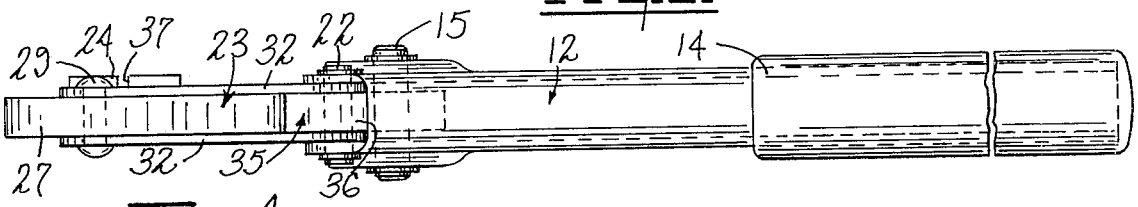
FIG. 2 represents an edge view of the tool, from the top or bottom of FIG. 1.

Referring to the drawing, a pair of arms 11, 12, having handle portions 13, 14 are pivotally connected adjacent their forward ends by means of the pivot pin 15. The arms are channel-shaped in cross-sections to define interior recesses 16, 17 and the channel sides are broadened in the forward portion of the arms, as shown at 18, 19, the pivot pin 15 being located near the free edges of the channel sides.

At points spaced from the pivot pin, in directions generally perpendicular to the length of the arms, journals are provided for the link pivot pins, 21, 22.

The die holder 23, is a U-shaped yoke having a work-engaging die 24 between the parallel guide surfaces 25, 26 on the side legs of the yoke. At the opposite ends of the die holder head 27 it is pivotally connected (28, 29) to the forward ends of pairs of side plates or links 31, 32, the rear ends of which are connected to the arms by the pivot pins 21, 22.

The ram 35 has a generally rectangular body, the sides of which have a free sliding fit with the guide surfaces 25, 26, and a rearwardly extending tail 36, bored to permit engagement with the pivot pin 15. The forward face 37 is suitably formed to cooperate with the die 24 in crimping a fitting or the like interposed between the die and ram. A spring 38 in the recess 16 is connected to one end of the bell crank-washer 39, pivoted on pin 15, the other end of which has a tab 39' engaging an edge of the arm 12, the spring thus acting to bias the arms toward their open positions (FIG. 3).

Figure 4:
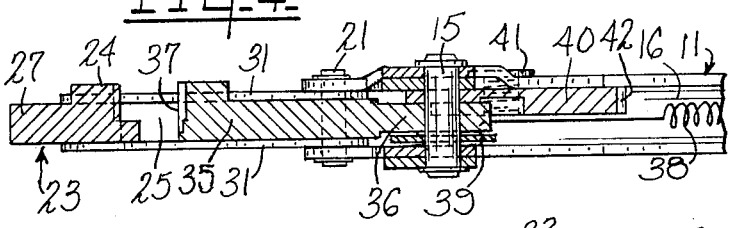
FIG. 4 represents a detail section on the line IV—IV of FIG. 3.

The motion-compelling mechanism (FIGS. 1 to 4) is functionally similar to that shown and claimed in Filia, U.S. Pat. No. 3,157,075 but will be described as adapted to the present crimping tool. The ratchet 40 is pivotally mounted at one end on the pivot pin 15 and lies in the recess 16 of arm 11, as shown in FIG. 4.

A bolt 41 in the adjacent wall of the recess 16 may include a cam portion, now shown, in engagement with the ratchet for precise adjustment of the position of the latter as explained more fully in the cited Filia patent. The rearward end of ratchet 40 is provided with a series of teeth 42, in an arc centered on pivot 15 and adapted to be engaged by pawl 43 pivotally mounted in handle 12 by means of pin 44. A spring 45 is attached between pawl 43 and handle 12 to yieldably maintain the pawl in desired position.

Figure 3:
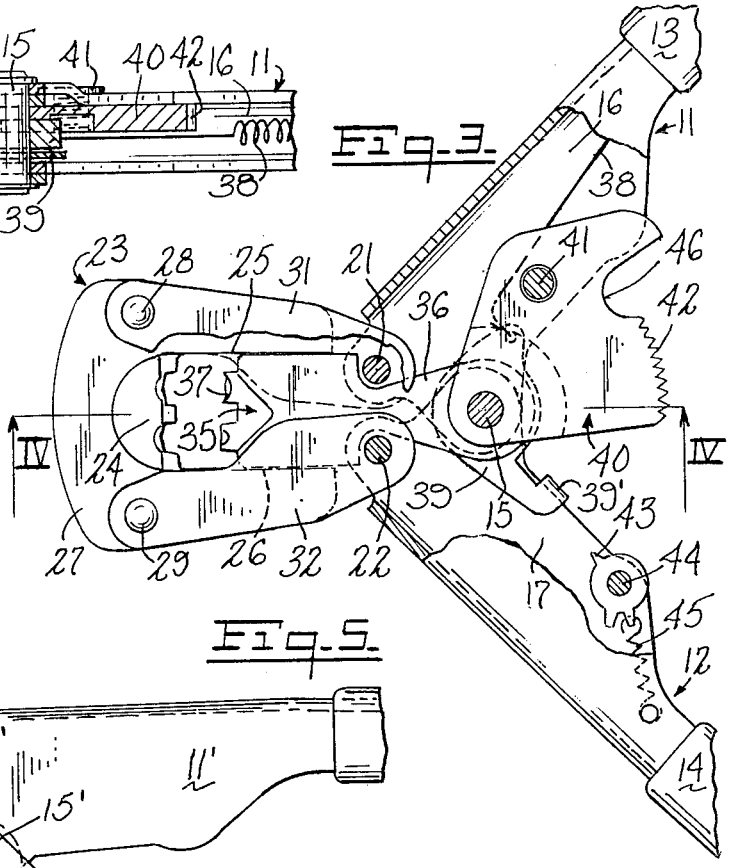
FIG. 3 represents a detail side elevation of the tool, in open position, parts being broken away and parts being in sections.

In operation, starting in the open position of FIG. 3 the arms are moved toward closed position and the link pivot points 21, 22 move apart, shortening the distance between pivot 15 and the die holder 23. Since the face 37 of ram 35 has a fixed relation to the pivot 15 and the die 24 is carried by the die holder, the ram and die approach each other with the continued closing of the arms, the ram being guided accurately in a straight line toward the die by the guide surfaces 25, 26. The working face portions of die 24 and ram 37 are shown as being integral with the die and ram, but separate interchangeable die and ram portions could be provided, if desired.

During this operation the motion-compelling mechanism becomes effective as soon as the teeth 42 engage the pawl 43, which is so angled that the teeth can click past the pawl in the closing direction but will prevent opening movement until the pawl has passed the last tooth. At that point the pawl will come to rest in the recess 46 at the end of the line of teeth, as shown in FIG. 1, maximum desired crimping having been effected and the wall of said recess acting as a stop. The tool can then be freely opened; in the opening direction the pawl does not lock the ratchet, having been rotated to a neutral position by the spring 45.

Figure 5:
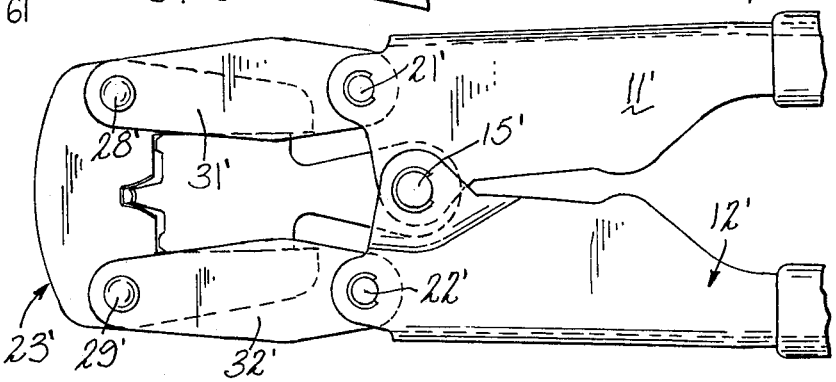
FIG. 5 represents a side elevation, as in FIG. 1, of a modified form of the tool, without motion-compelling mechanism.

In the modified form of tool shown in FIG. 5 the crimping parts are the same as those described above, some of the corresponding elements being identified at 11', 12', 15', 21', 22', 23', 28', 31' and 32.

Figure 6:
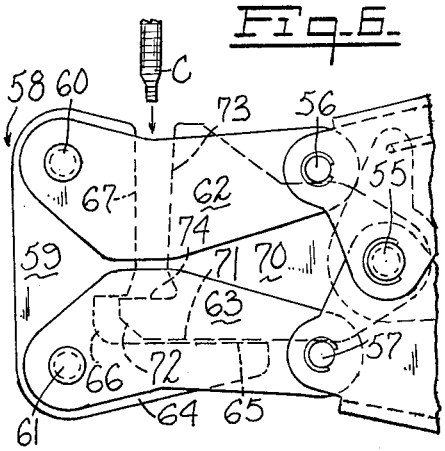
FIG. 6 represents a detail side elevation, as in FIGS. 1, 3 and 5, of another modified form of the tool, adapted to receive a terminal inserted in the edge of the tool.

In the further modified form of FIG. 6 the pivot pins 55, 56 and 57 correspond to the pivot pins 15, 21 and 22 of FIG. 1, the die holder 58 corresponds to die holder 23 having opposite ends of its head 59 pivotally connected at 60 and 61 to the pairs of side plates or links 62, 63, corresponding to links 31, 32 but wider for added strength and stability. The die holder has a single leg 64 providing a guide surface 65 which terminates forwardly in the guide slot 66 adjacent which is the die working surface 67 extending out to an edge of the tool, between the links 62 and lying substantially perpendicular to the guide surface 65.

The ram 70 is carried on the pivot pin 55 and is formed with a flat surface 71 adapted to slide on the guide surface 65, a tongue 72 fitting freely into the slot 66 and a working surface 73 facing the surface 67 and parallel thereto or slightly divergent therefrom. The surface 74 of the tongue lies substantially parallel to the surface 71. The edges of the ram, adjacent the pivot pins 56 and 57, are so disposed as to act as stops for the opening movement of the handles, as shown in FIG. 6, which represents the open position of this form of tool. The throw required to compress a connector C of the type for which this tool is designed is less than that required in the tools of FIGS. 1 to 5 so that the opening movement may be limited as just described; most importantly such limitation prevents the tongue 72 from retracting out of its guide slot. Any movement of the handles to bring the pivot pins 55, 56 and 57 more nearly into alignment advances the ram surface 73 toward the die surface 67 to compress, with a straight line motion, a connector inserted into the edge of the tool between said surfaces.

It will be observed that while the rams 35 and 70 are guided by the rectilinear surfaces 25, 26 or the parallel walls of slot 66, respectively, they are also held in alignment by the overlapping side edges of the pairs of side plates or links 31, 32 or 62, 63.

This tool, in each of its modifications, is very simple to manufacture and is convenient and reliable in use. The crimping elements are so formed and proportioned that they can be made entirely of powder metal if desired, in order to reduce the expense.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawing shall be interpreted as illustrative and not in a limiting sense.

I claim:

1. A crimping tool comprising two arms pivotally connected adjacent one end, a die holder having a head portion and one side leg portion and a working surface extending toward the edge of the tool opposite said leg portion, the die holder having parallel spaced guide surfaces and the head portion having a die, links pivotally connecting each end of the head portion to each of the arms, respectively, the links being pivotally connected to the arms at points laterally offset from the arm pivot in a direction substantially perpendicular to the length of the arms, and a ram fixed to the arm pivot and extending between the guide surfaces toward the die head portion, the guide surfaces defining a slot between the head portion and the leg portion and the ram being formed with a tongue extending into said slot, the pivoted connections of the links to the arms including pivot pins and the ram edges being disposed in positions to contact said pivot pins to limit the tool opening movement.

* * * * *

UNITED STATES PATENT AND TRADEMARK OFFICE

CERTIFICATE OF CORRECTION

PATENT NO. : 4,080,820

DATED : March 28, 1978

INVENTOR(S) : Irving Allen

It is certified that error appears in the above-identified patent and that said Letters Patent are hereby corrected as shown below:

Column 2, line 37, the word "now" should read --not--.

Column 3, line 5, the word "at" should read --as--.

Column 3, line 6, insert after " 28' " and before " 31' " the number -- 29' --.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*